US008482368B2

(12) United States Patent
Sasaki et al.

(10) Patent No.: US 8,482,368 B2
(45) Date of Patent: Jul. 9, 2013

(54) ELECTROMAGNETIC RELAY

(75) Inventors: Ryuji Sasaki, Tokyo (JP); Takashi Yuba, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/010,959

(22) Filed: Jan. 21, 2011

(65) Prior Publication Data

US 2011/0181381 A1 Jul. 28, 2011

(30) Foreign Application Priority Data

Jan. 26, 2010 (JP) ..... 2010-014530

(51) Int. Cl.
*H01H 33/18* (2006.01)

(52) U.S. Cl.
USPC ..... 335/201; 335/78

(58) Field of Classification Search
USPC ..... 335/78–86, 124, 128–135, 201; 218/26, 218/41
See application file for complete search history.

(56) References Cited

U.S. PATENT DOCUMENTS

| | | | | |
|---|---|---|---|---|
| 4,509,025 | A * | 4/1985 | Kimpel et al. | 335/85 |
| 6,075,429 | A * | 6/2000 | Uotome et al. | 335/78 |
| 6,700,466 | B1 * | 3/2004 | Yamamoto et al. | 335/132 |
| 7,145,422 | B2 * | 12/2006 | Imanishi et al. | 335/201 |
| 7,541,901 | B2 * | 6/2009 | Nakano et al. | 335/201 |
| 7,782,162 | B2 * | 8/2010 | Nishida | 335/201 |
| 2009/0072935 | A1 * | 3/2009 | Yuba et al. | 335/201 |
| 2010/0265630 | A1 * | 10/2010 | Baxter et al. | 361/209 |

FOREIGN PATENT DOCUMENTS

JP 2001-176370 6/2001

* cited by examiner

*Primary Examiner* — Bernard Rojas
(74) *Attorney, Agent, or Firm* — IPUSA, PLLC

(57) ABSTRACT

An electromagnetic relay includes multiple contact sets each including a fixed contact and a movable contact displaceable in a first direction to approach the fixed contact and in a second direction to move away from the fixed contact; multiple permanent magnets each provided on the peripheral side of a corresponding one of the contact sets and having a polarity direction perpendicular to the first and second directions; and multiple ferromagnetic bodies parallel to the polarity directions of the permanent magnets and the first and second directions, wherein in a DC electric current flowing through each of the contact sets, the direction of a force exerted based on the permanent magnet is equal to the direction of a force exerted based on the ferromagnetic body.

16 Claims, 10 Drawing Sheets

ELECTROMAGNETIC RELAY

CROSS-REFERENCE TO RELATED APPLICATION

The present application is based upon and claims the benefit of priority of Japanese Patent Application No. 2010-014530, filed on Jan. 26, 2010, the entire contents of which are incorporated herein by reference.

BACKGROUND OF THE INVENTION

1. Field of the Invention

The present invention relates to a relay or an electromagnetic relay configured to turn on and off a domestic or industrial electric apparatus.

2. Description of the Related Art

In an electromagnetic relay, under the condition that the voltage applied to a contact point formed by a fixed contact and a movable contact, which is opened and closed, is high and current flowing through the contact point is large, there is concern for generation of an arc when the voltage becomes higher than a minimum arc voltage or the current becomes larger than a minimum arc current at the time of the fixed contact and the movable contact in contact with each other moving away from each other with the movement of the movable contact in a direction away from the fixed contact or the fixed contact and the movable contact out of contact with each other moving toward each other with the movement of the movable contact in a direction toward the fixed contact.

With an electrical load applied between the fixed contact and the movable contact, electric current moves through the gap between the surface of the fixed contact and the surface of the movable contact. This phenomenon is referred to as an arc. The arc starts when electrons reach the positive terminal across the gap from the negative terminal. The electrons collide with and ionize molecules of air while moving through the gap. The electrons reach the positive terminal to heat the positive terminal, so that positive ions are released into the gap from the positive terminal. The positive ions collide with the negative terminal to heat the negative terminal as well.

Heat is thus generated at each of the positive terminal and the negative terminal to cause evaporation of molecules of the positive electrode and the negative electrode. As a result, the abrasion of the surfaces of the fixed contact and the movable contact increases, and the generation of the arc causes the electrically conducting state to continue at the time of interrupting electric current in particular, thus degrading interruption performance. Therefore, it is desired to suppress or extinguish the generated arc with efficiency in terms of both increasing the durability of the contacts and improving the interruption performance.

The above-described demand for arc suppression or extinguishing is particularly strong in the case of inserting a relay or an electromagnetic relay, in order to completely interrupt electric current, in a circuit containing an uninterruptible power supply (UPS) having the function of being activated to supply high-voltage direct-current (DC) power when a commercial power supply to a load such as a computer system fails or in a circuit containing a battery to supply DC power to a load such as an inverter in an electric vehicle.

For example, Japanese Laid-Open Patent Application No. 2001-176370 describes an electromagnetic relay capable of suppressing or extinguishing such an arc.

SUMMARY OF THE INVENTION

According to one aspect of the present invention, an electromagnetic relay includes a plurality of contact sets each including a fixed contact and a movable contact displaceable in a first direction to approach the fixed contact and in a second direction to move away from the fixed contact; a plurality of permanent magnets each provided on a peripheral side of a corresponding one of the contact sets and having a polarity direction perpendicular to the first and second directions; and a plurality of ferromagnetic bodies parallel to the polarity directions of the permanent magnets and the first and second directions, wherein in a DC electric current flowing through each of the contact sets, a direction of a force exerted based on the permanent magnet is equal to a direction of a force exerted based on the ferromagnetic body.

The object and advantages of the embodiments will be realized and attained by means of the elements and combinations particularly pointed out in the claims.

It is to be understood that both the foregoing general description and the following detailed description are exemplary and explanatory and not restrictive of the invention as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

In such an electromagnetic relay as described in Japanese Laid-Open Patent Application No. 2001-176370 mentioned above, using the fact that the arc has the same magnetic properties as electric current, an electromagnetic force based on Fleming's left-hand rule due to magnetic flux caused by a magnet positioned near the contact is caused to act on the arc to bend its direction, so that the arc is deflected and blown off to be extinguished.

However, Japanese Laid-Open Patent Application No. 2001-176370 merely discloses providing an electromagnetic relay in an interconnect connecting the positive terminal side of a direct-current power supply and a circuit including a load in the electromagnetic relay. Therefore, the negative terminal side of the DC power and the load circuit continue to be connected even when the contacts are open, so that there is no guarantee that the DC power supply and the load are completely independent of each other electrically. Therefore, there is a problem in that if the ground-side potential is unstable for some reason such as inductivity in the circuit, the circuit including the load may continue to be supplied with electric current to degrade the opening and closing performance.

Further, when consideration is given to the improvement of the arc deflection effect, it is preferable to make effective use of a space around the above-mentioned gap. However, even if multiple magnets to provide the gap with magnetic flux in different directions are installed, restrictions on the magnet arrangement prevent multiple magnetic flux vectors from being superposed in the same direction. Therefore, only with the technique using magnets, it is difficult to sufficiently increase a force to deflect an arc, and there is also caused the problem of the inability to sufficiently increase the arc suppression (extinguishing) effect.

According to one aspect of the present invention, an electromagnetic relay may be provided that is improved in the arc suppression (extinguishing) effect as well as the opening and closing performance.

A description is given below, with reference to the accompanying drawings, of embodiments of the present invention.

[a] First Embodiment

Figure 1:
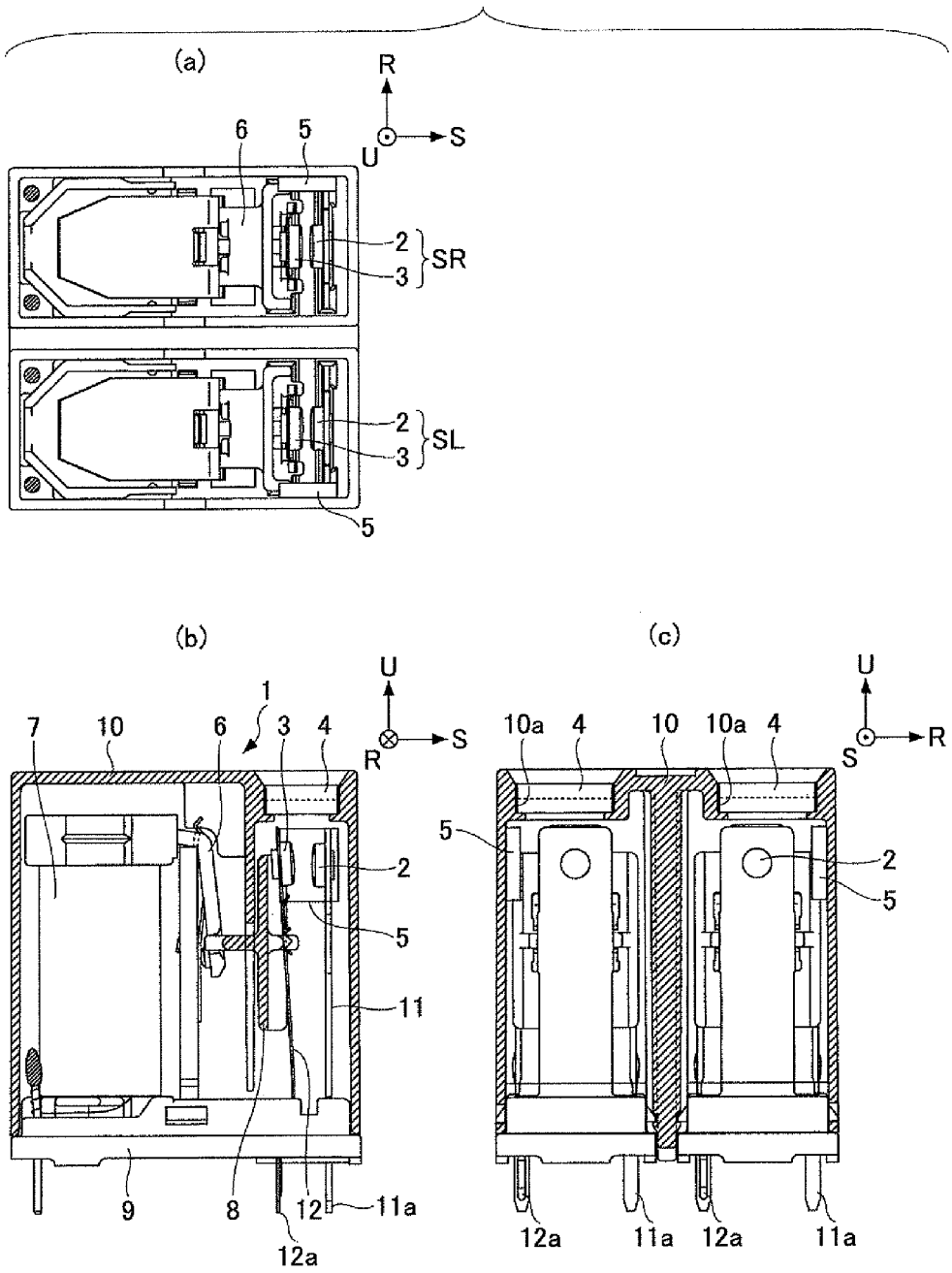
FIG. 1 is a schematic diagram illustrating an electromagnetic relay according to a first embodiment of the present invention.

In FIG. 1, (a), (b), and (c) are schematic cross-sectional views of an electromagnetic relay 1 according to a first embodiment, taken along planes perpendicular to below-illustrated three directions U, S, and R, respectively. Of the three directions, direction R indicates the rightward direction of the right-left (lateral) directions in which two sets of contacts SL and SR are adjacently disposed, direction S indicates the approaching direction of the approaching-leaving directions in which a movable contact 3 draws near to or moves away from a fixed contact 2, and direction U indicates the upward direction of the vertical (up-down) directions perpendicular to the right-left directions and the approaching-leaving directions.

Figure 2:
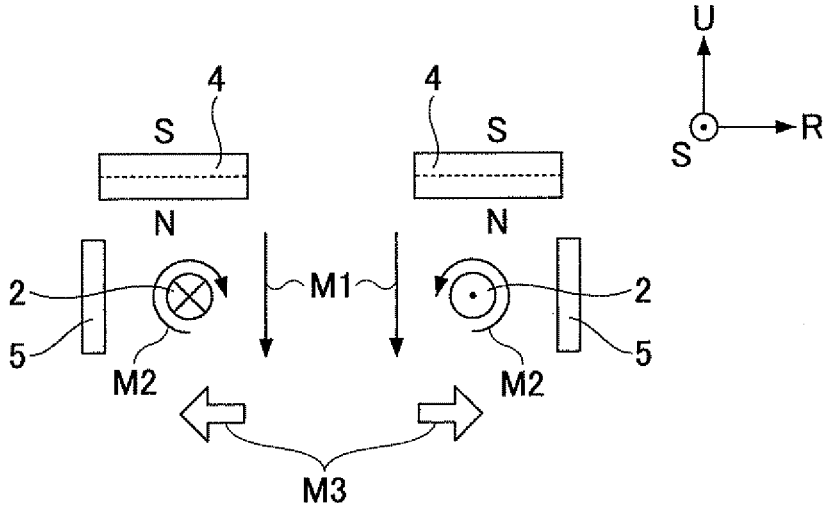
FIG. 2 is a schematic diagram illustrating part of the electromagnetic relay according to the first embodiment of the present invention.

Here, direction U coincides with the direction from a base 9 to a case 10. Further, direction R indicates the rightward direction in a view from direction S. Direction U, direction R, and direction S, or the approaching direction, are perpendicular to one another. The same applies to the directions shown in FIG. 2 and the subsequent drawings. FIG. 2 is a schematic diagram illustrating a correlation between the positions of permanent magnets 4 and ferromagnetic bodies 5, which are components of the electromagnetic relay 1 of the first embodiment, and the directions of electric current and electromagnetic forces.

Referring to FIG. 1, the electromagnetic relay 1 of the first embodiment includes the two sets of contacts (a pair of left and right contact sets) SL and SR, each formed of the fixed contact 2 and the corresponding movable contact 3 displaceable in its approaching-leaving directions. The two fixed contacts 2 are arranged side by side in direction R. Further, the electromagnetic relay 1 includes the two permanent magnets 4 disposed on the peripheral side of the two sets of contacts SL and SR, respectively. The permanent magnets 4 have a polarity direction perpendicular to the approaching-leaving directions and opposite to direction U. Further, the electromagnetic relay includes the two ferromagnetic bodies 5 parallel to the polarity direction of the two permanent magnets 4 and the approaching-leaving directions. In the DC electric current supplied to (flowing through) each of the two sets of contacts SL and SR, the direction of a force exerted based on the permanent magnet 4 and the direction of a force exerted based on the ferromagnetic body 5 are the same. Further, the contact sets SL and SR are adjacently disposed so that the approaching-leaving directions of the set of contacts SL and the approaching-leaving directions of the set of contacts SR are parallel to each other.

In addition, as illustrated in FIG. 1, the electromagnetic relay 1 includes actuators 6, drive parts 7 configured to drive the respective actuators 6, cards 8 configured to press the respective movable contacts 3 based on the driving of the actuators 6, the base 9 on which the drive parts 7 are placed, and the case 10 (case component) forming an outer shell that defines an exterior space and an interior space.

Here, as illustrated in FIG. 2, the approaching-leaving directions of the contact sets SL and SR are parallel to each other, and the two permanent magnets 4 have the same polarity direction with the north pole being on the side opposite to direction U. Further, the ferromagnetic bodies 5 have their respective surfaces on the side of the set of contacts SL and the side of the set of contacts SR exposed to the interior space of the case 10. The permanent magnets 4 have their respective surfaces on the side of the set of contacts SL and the side of the set of contacts SR exposed to the interior space of the case 10.

The ferromagnetic bodies 5 are formed of, for example, one of iron, cobalt, nickel, an iron-containing alloy, a cobalt-containing alloy, and a nickel-containing alloy.

Further, the electromagnetic relay 1 includes fixed-side spring terminals 11 electrically connected to the respective fixed contacts 2 and movable-side spring terminals 12 electrically connected to the respective movable contacts 3. The fixed-side spring terminals 11 are provided through and fixed to the base 9 so that respective terminal portions 11*a* on the side opposite to direction U are exposed to the outside. The movable-side spring terminals 12 are provided through and fixed to the base 9 so that respective terminal portions 12*a* on the side opposite to direction U are exposed to the outside.

Each of the movable-side spring terminals 12 has the function of urging the movable contact 3 in the direction opposite to direction S (approaching direction) relative to the fixed contact 2 and the function of transmitting a force in direction S (approaching direction) to the movable contact 3 in response to receiving a pressing force due to the card 8 of the actuator 6 driven by the drive part 7. The drive parts 7 and the actuators 6 are housed in the housing space of the case 10.

In addition, the actuators 6 have their respective shafts parallel to direction R supported by bearing parts (not graphically illustrated) in the housing space of the case 10 so as to be swingable about the shafts. The permanent magnets 4 are pressed from outside into through-hole recesses 10*a* provided in a top plate part of the case 10 on the side of direction U and fixed to the case 10 so as to be opposed to the contact sets SL and SR. The recesses 10*a* have respective openings (through holes) on the side opposed to the contact sets SL and SR. The permanent magnets 4 are exposed to the interior space containing the contact sets SL and SR through these openings. The ferromagnetic bodies 5 are joined from inside the case 10 to wall faces of the case 10 perpendicular to direction R and on the outer side in the right-left directions with an adhesive agent to be fixed to be opposed to the contact sets SL and SR.

The fixed contacts 2 fixed to the fixed-side spring terminals 11 and the movable contacts 3 fixed to the movable-side spring terminals 12 each have an umbrella-like shape of a combination of a partial cone, which is covered and bottomed, and a cylinder. The cylinder portion forms an attachment part by caulking, and the partial cone portion forms a contact part.

The fixed contacts 2 and the movable contacts 3 have respective center axes. The center axis of each of the fixed contacts 2 is always parallel to direction S (approaching direction). The center axis of each of the movable contacts 3 is parallel to direction S (approaching direction) when the movable contact 3 and the corresponding fixed contact 2 are in contact to close the contact set SL or SR. In an open state, which is the state other than the closed state where the contact set SL or SR is closed by the fixed contact 2 and the movable contact 3 to allow electric current to flow, the movable contact 3 is swung based on the urging force and the flexure of the movable-side spring terminal 12 so as to be apart from the corresponding fixed contact 2 by a certain gap.

Each of the drive parts 7 includes a set coil and a reset coil (not graphically illustrated). When a close command signal is applied to the set coil with the contact set SL or SR formed of the fixed contact 2 and the movable contact 3 being open, the drive part 7 generates a magnetic force in a direction to attract the actuator 6 with its coil and iron core so that the actuator 6 is attracted and driven. With the driving of the actuator 6, the card 8 presses the movable-side spring terminal 12 in the approaching direction (direction S), so that the movable contact 3 comes into contact with the fixed contact 2 to close the contact set SL or SR.

When an open command signal is applied to the reset coil with the contact set SL or SR formed of the fixed contact 2 and the movable contact 3 being closed, the magnetic force in the direction to attract the actuator 6 generated with the coil and iron core of the drive part 7 is reduced, so that an urging force in the direction opposite to the approaching direction (direction S) of the movable-side spring terminal 12 causes the movable contact 3 to be separated from the fixed contact 2 to open the contact set SL or SR.

In the open state and the closed state, when neither the set coil nor the reset coil is energized, the open state or the closed state is self-maintained with the residual flux of the iron core and the yoke and the residual flux of the armature and the magnetic flux maintaining magnet. That is, the electromagnetic relay 1 of this first embodiment is a polarized relay and latching relay.

According to the electromagnetic relay 1 of this first embodiment, effects such as the following may be produced by providing the permanent magnets 4 and the ferromagnetic bodies 5 having a predetermined positional relationship as described above near the contact sets SL and SR.

That is, magnetic flux generated in the direction opposite to direction U (indicated by arrow M1 in FIG. 2) by the permanent magnet 4 and spiral magnetic flux generated around an arc (indicated by arrow M2 in FIG. 2) by the arc having a function as an electric current interact to generate an electromagnetic force of Fleming's left-hand rule (indicated by double-line arrow M3 in FIG. 2), so that the arc generated in the gap between the fixed contact 2 and the movable contact 3 with the opening and closing of the contact set SR or SR may be deflected and blown off in the direction opposite to direction R in the contact set SL or in direction R in the contact set SR.

As well as this, the ferromagnetic body 5 is caused to exert an attractive force to attract the arc in the same direction as the direction in which the electromagnetic force is generated. This makes it possible to further ensure that the arc is led to and then absorbed by the ferromagnetic body 5 based on the action of both the electromagnetic force and the attractive force.

As a result, it is possible to lead the arc to the ferromagnetic body 5 before the arc reaches one of the fixed contact 2 and the movable contact 3 from the other, and to cause the energy of the arc to be electrically and thermally absorbed by the ferromagnetic body 5 to suppress or extinguish the arc.

This makes it possible to prevent the surfaces of the fixed contact 2 and the movable contact 3 from being heated and evaporated by the arc as much as possible, and to prevent occurrence of abrasion on the surfaces of the fixed contact 2 and the movable contact 3 as much as possible.

Further, by weakening the arc by causing it to go through the ferromagnetic body 5, it is also possible to prevent the arc from going through the fixed-side spring terminal 11 and the movable-side spring terminal 12. Therefore, it is also possible to improve the durability of the fixed-side spring terminal 11 and the movable-side spring terminal 12.

In addition, by weakening the arc with the ferromagnetic body 5, it is possible to prevent the degradation of the interruption performance and the opening and closing performance due to the arc-caused continuation of electrical conduction between the movable contact 3 and the fixed contact 2 at the time of opening the contact set SL or SR of the electromagnetic relay 1. Further, it is also possible to prevent an arc-caused earlier start of electrical conduction than is desired or an arc-caused unstable start of electrical conduction at the time of closing the contact set SL or SR of the electromagnetic relay 1. This also makes it possible to improve the opening and closing performance.

Further, according to the electromagnetic relay 1 of this first embodiment, there is no need to increase the fixed contact 2 and the movable contact 3 in volume or number in order to increase their electrical and thermal capacities or to increase the gap between the fixed contact 2 and the movable contact 3. Therefore, it is possible to prevent an increase in cost that would be caused by their implementation. Further, the ferromagnetic body 5, which is caused to absorb the electrical and thermal energy of the arc, is provided as a component separate from components contributing to the DC-current conducting and interrupting function of the electromagnetic relay 1. This makes it possible to prevent the properties of the components contributing to the opening and closing operation from being affected, so that it is possible to ensure the abrasion prevention effect particularly in the case of conducting and interrupting a large electric current.

Further, as indicated by double-line arrows M3 in FIG. 2, the electromagnetic force and the attractive force may be exerted in opposite directions between the two sets of contacts SL and SR. Therefore, it is possible to cancel a force exerted on the electromagnetic relay 1 by the reaction of the electromagnetic force and the attractive force. This makes it possible to prevent a reaction force resulting from blowing off the arc from being exerted continuously on the electromagnetic relay 1, so that it is possible to improve the durability of the electromagnetic relay 1 and also the durability of a board on which the electromagnetic relay 1 is to be mounted.

Further, according to the electromagnetic relay 1 of this first embodiment, the direction of the electromagnetic force and the attractive force of the contact set SL and the direction of the electromagnetic force and the attractive force of the contact set SR are opposite and outward from the center in the right-left directions. This makes it possible to dispose the ferromagnetic bodies 5 one on each wall face of the case 10 on the outer side in the right-left directions in a view of the electromagnetic relay 1 from direction S (approaching direction). This makes it possible to assemble and manufacture the electromagnetic relay 1 with more ease.

In addition, the electromagnetic relay 1 of this first embodiment 1 includes the two sets of contacts SL and SR. Therefore, it is possible to open and close both the positive terminal side and the negative terminal side of a load by, for example, suitably inserting and connecting the terminal portions 11*a* and 12*a* of the contact sets SL and SR to circuits on the positive terminal side and the negative terminal side of the load connected to a DC power supply. Therefore, it is possible to prevent electric current from flowing through the load for some reason such as inclusion of an inductive element in the circuits after interrupting the electric current by opening contacts. As a result, it is possible to improve the opening and closing performance.

In addition, according to the electromagnetic relay 1 of this first embodiment, the surfaces of the ferromagnetic bodies 5 on the side of the contact set SL and on the side of the contact set SR are exposed to the interior space of the case 10. Therefore, it is possible to ensure a sufficient attractive force to attract an arc and to ensure absorption of the arc by each of the ferromagnetic bodies 5. Further, the surfaces of the permanent magnets 4 on the side of the contact set SL and on the side of the contact set SR also are exposed to the interior space of the case 10. Therefore, it is possible to ensure a sufficient electromagnetic force to be exerted on an arc and to ensure a force to deflect the arc generated by each of the permanent magnets 4. However, the permanent magnets 4 may be covered with molding resin or the like relative to the interior space as long as it is possible to ensure an electromagnetic force.

Figure 3:
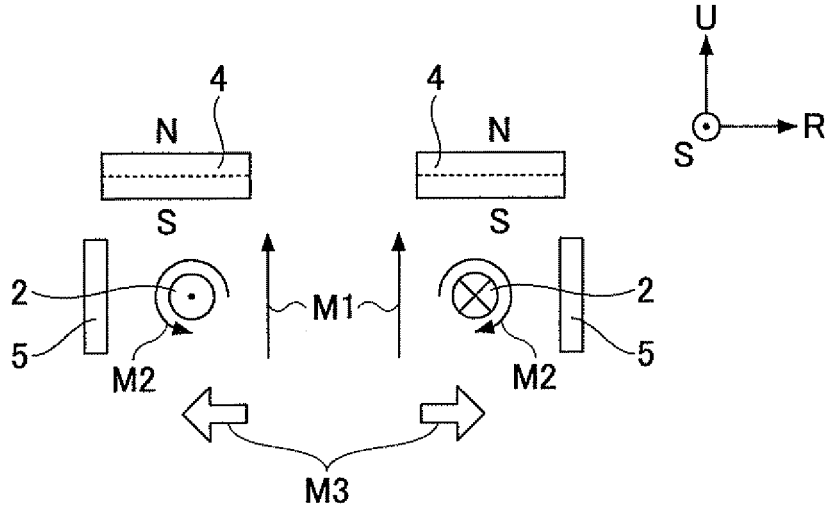
FIG. 3 is a schematic diagram illustrating part of the electromagnetic relay according to a variation of the first embodiment of the present invention.

The correlation between the positions of permanent magnets 4 and ferromagnetic bodies 5 and the directions of electric current and electromagnetic forces illustrated in FIG. 2 are an example, and may be suitably modified. In causing the two adjacent sets of contacts SL and SR to be opposite from each other in the direction of an electromagnetic force and an attractive force to be exerted, the correlation between their positions may be as illustrated in FIG. 3. FIG. 3 is a schematic diagram illustrating a variation of the correlation between the positions of the permanent magnets 4 and the ferromagnetic bodies 5, which are components of the electromagnetic relay 1 of the first embodiment, and the directions of electric current and electromagnetic forces.

That is, the two flat-plate permanent magnets 4 are perpendicular to direction U with the north pole on the side of direction U, the two rectangular parallelepiped ferromagnetic bodies 5 are perpendicular to direction R, the direction of electric current supplied to the left contact set SL is direction S (approaching direction) coming out of the plane of the paper, and the direction of electric current supplied to the right contact set SR is the direction going into the plane of the paper, that is, the direction opposite to direction S (approaching direction). In FIG. 3, the magnetic flux generated by each of the permanent magnets 4 is indicated by straight arrow M1, and the magnetic flux generated by an arc is indicated by rounding arrow M2.

Figure 4:
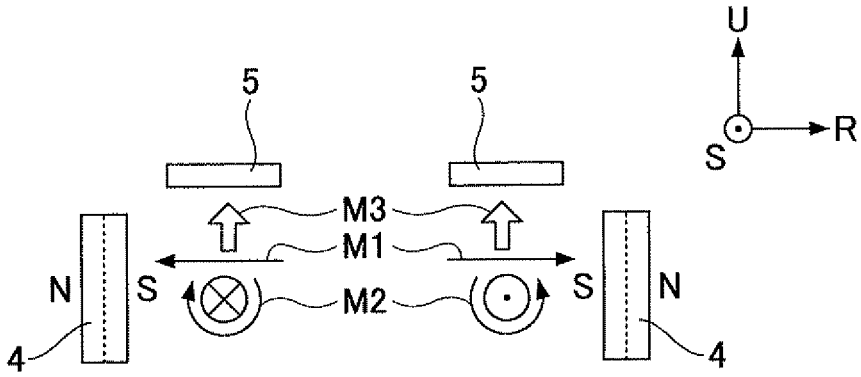
FIG. 4 is a schematic diagram illustrating part of the electromagnetic relay according to another variation of the first embodiment of the present invention.

Like the positional correlation illustrated in FIG. 2, the position correlation illustrated in FIG. 3 also makes it possible to exert an electromagnetic force and an attractive force for an arc outward in the right-left directions, thereby causing the arc to go through the ferromagnetic body 5 and be extinguished and canceling a reaction force. If there is little demand for cancellation of a reaction force, the positional correlation may be as illustrated in FIG. 4. FIG. 4 is a schematic diagram illustrating another variation of the correlation between the positions of the permanent magnets 4 and the ferromagnetic bodies 5, which are components of the electromagnetic relay 1 of the first embodiment, and the directions of electric current and electromagnetic forces.

As illustrated in FIG. 4, the two flat-plate permanent magnets 4 are perpendicular to direction R with the south pole on the side opposed to (facing) the contact set SL or SR, the two rectangular parallelepiped ferromagnetic bodies 5 are perpendicular to direction U, the direction of electric current supplied to the left contact set SL is the direction going into the plane of the paper, that is, the direction opposite to direction S (approaching direction), and the direction of electric current supplied to the right contact set SR is direction S (approaching direction) coming out of the plane of the paper. In FIG. 4 as well, the magnetic flux generated by each of the permanent magnets 4 is indicated by straight arrow M1, and the magnetic flux generated by an arc is indicated by rounding arrow M2.

Figure 5:
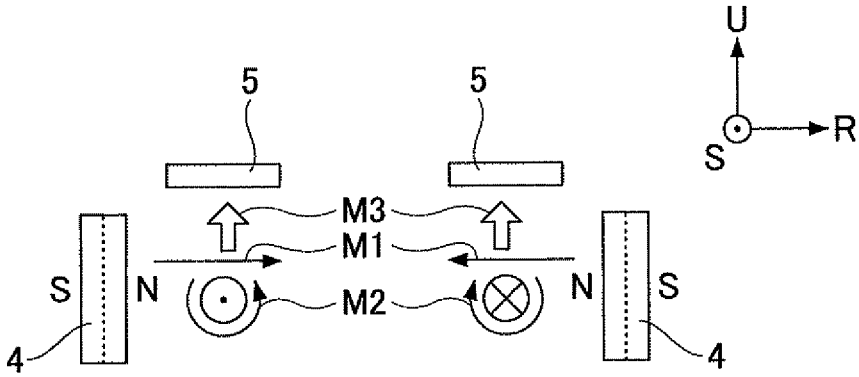
FIG. 5 is a schematic diagram illustrating part of the electromagnetic relay according to yet another variation of the first embodiment of the present invention.

According to the positional correlation illustrated in FIG. 4, it is possible to cause an electromagnetic force and an attractive force for an arc to be exerted toward direction U and to cause the arc to go through the ferromagnetic body 5 to be extinguished. The positional correlation illustrated in FIG. 4 may be replaced with the positional correlation illustrated in FIG. 5. FIG. 5 is a schematic diagram illustrating yet another variation of the correlation between the positions of the permanent magnets 4 and the ferromagnetic bodies 5, which are components of the electromagnetic relay 1 of the first embodiment, and the directions of electric current and electromagnetic forces.

In FIG. 5, the two flat-plate permanent magnets 4 are perpendicular to direction R with the north pole on the side opposed to (facing) the contact set SL or SR, the two rectangular parallelepiped ferromagnetic bodies 5 are perpendicular to direction U, the direction of electric current supplied to the left contact set SL is direction S (approaching direction) coming out of the plane of the paper, and the direction of electric current supplied to the right contact set SR is the direction going into the plane of the paper, that is, the direction opposite to direction S (approaching direction). In FIG. 5 as well, the magnetic flux generated by each of the permanent magnets 4 is indicated by straight arrow M1, and the magnetic flux generated by an arc is indicated by rounding arrow M2. This positional correlation also makes it possible to cause an electromagnetic force and an attractive force for an arc to be exerted toward direction U and to cause the arc to go through the ferromagnetic body 5 to be extinguished.

The above-mentioned positional correlation is not limited to those illustrated in FIG. 2 through FIG. 5, and may be any of those illustrated in FIG. 6 through FIG. 9, for example. FIG. 6 through FIG. 9 are schematic diagrams illustrating other variations of the correlation between the positions of the permanent magnets 4 and the ferromagnetic bodies 5, which are components of the electromagnetic relay 1 of the first embodiment, and the directions of electric current and electromagnetic forces.

Figure 6:
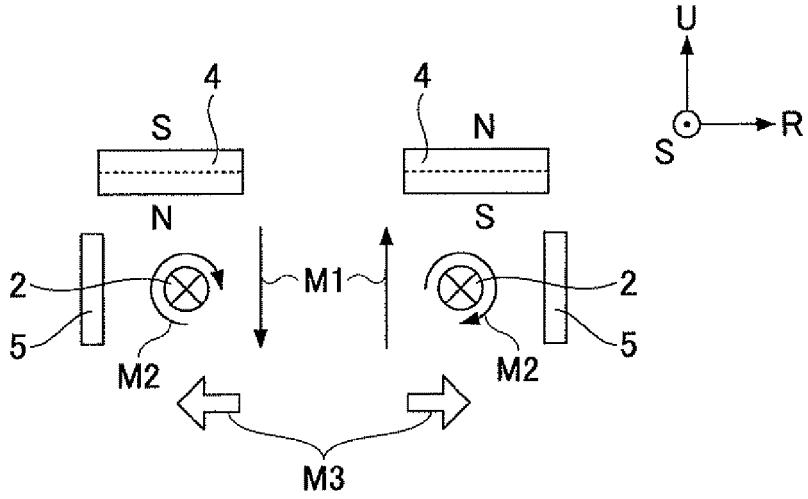
FIG. 6 is a schematic diagram illustrating part of the electromagnetic relay according to yet another variation of the first embodiment of the present invention.

That is, in FIG. 6, the two flat-plate permanent magnets 4 are perpendicular to direction U with one on the side of the contact set SL having its north pole on the side opposed to (facing) the contact set SL and the other on the side of the contact set SR having its south pole on the side opposed to (facing) the contact set SR. Further, the two rectangular parallelepiped ferromagnetic bodies 5 are perpendicular to direction R, the direction of electric current supplied to the left contact set SL is the direction going into the plane of the paper, that is, the direction opposite to direction S (approaching direction), and the direction of electric current supplied to the right contact set SR is the direction going into the plane of the paper, that is, the direction opposite to direction S (approaching direction).

Figure 7:
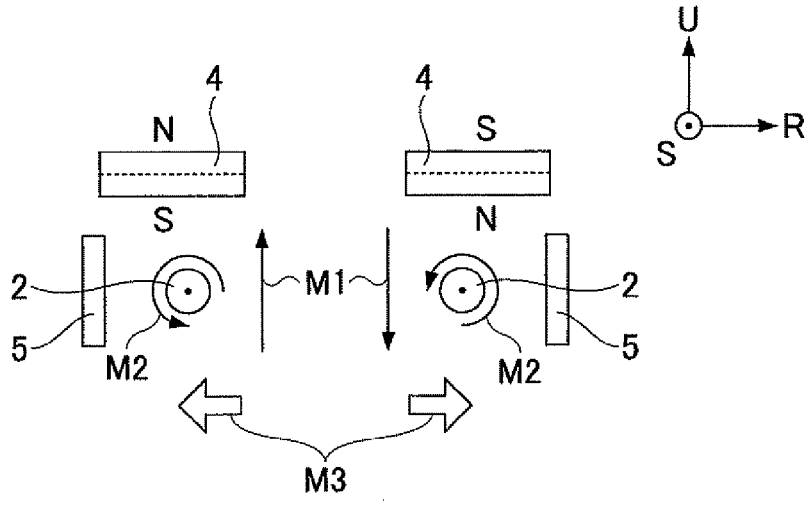
FIG. 7 is a schematic diagram illustrating part of the electromagnetic relay according to yet another variation of the first embodiment of the present invention.

Likewise, in FIG. 7, the two flat-plate permanent magnets 4 are perpendicular to direction U with one on the side of the contact set SL having its south pole on the side opposed to (facing) the contact set SL and the other on the side of the contact set SR having its north pole on the side opposed to (facing) the contact set SR. Further, the two rectangular parallelepiped ferromagnetic bodies 5 are perpendicular to direction R, the direction of electric current supplied to the left contact set SL is direction S (approaching direction) coming out of the plane of the paper, and the direction of electric current supplied to the right contact set SR is direction S (approaching direction) coming out of the plane of the paper.

In FIG. 6 and FIG. 7, an electromagnetic force and an attractive force exerted on supplied electric current are directed outward in the left-right directions as indicated by double-line arrows M3 as in those illustrated in FIG. 2 and FIG. 3, and the same effects as in those illustrated in FIG. 2 and FIG. 3 are produced.

Figure 8:
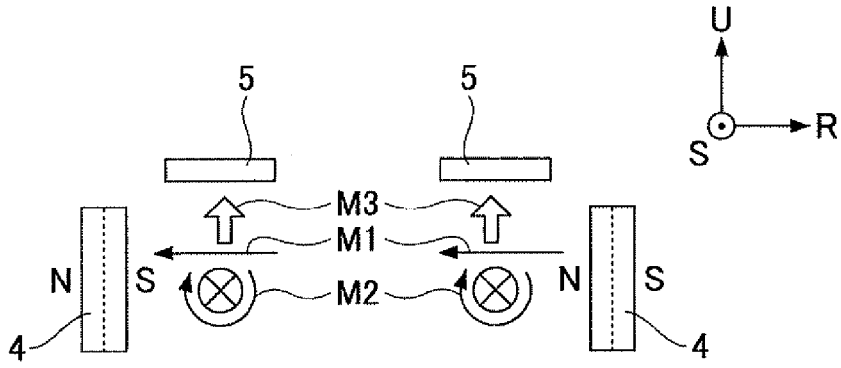
FIG. 8 is a schematic diagram illustrating part of the electromagnetic relay according to yet another variation of the first embodiment of the present invention.

Further, in FIG. 8, the two flat-plate permanent magnets 4 are perpendicular to direction R with one on the side of the contact set SL having its south pole on the side opposed to (facing) the contact set SL and the other on the side of the contact set SR having its north pole on the side opposed to (facing) the contact set SR. Further, the two rectangular parallelepiped ferromagnetic bodies 5 are perpendicular to direction U, the direction of electric current supplied to the left contact set SL is the direction going into the plane of the paper, that is, the direction opposite to direction S (approaching direction), and the direction of electric current supplied to the right contact set SR is the direction going into the plane of the paper, that is, the direction opposite to direction S (approaching direction).

Figure 9:
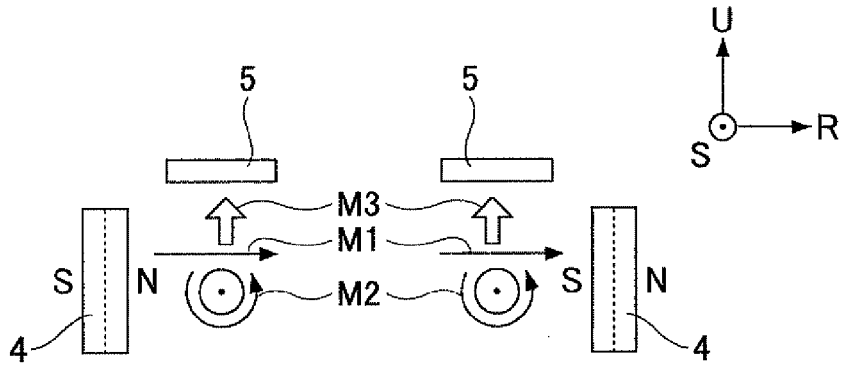
FIG. 9 is a schematic diagram illustrating part of the electromagnetic relay according to yet another variation of the first embodiment of the present invention.

Likewise, in FIG. 9, the two flat-plate permanent magnets 4 are perpendicular to direction R with one on the side of the contact set SL having its north pole on the side opposed to (facing) the contact set SL and the other on the side of the contact set SR having its south pole on the side opposed to (facing) the contact set SR. Further, the two rectangular parallelepiped ferromagnetic bodies 5 are perpendicular to direction U, the direction of electric current supplied to the left contact set SL is direction S (approaching direction) coming out of the plane of the paper, and the direction of electric current supplied to the right contact set SR is direction S (approaching direction) coming out of the plane of the paper.

In FIG. 8 and FIG. 9, an electromagnetic force and an attractive force exerted on supplied electric current are in direction U as indicated by double-line arrows M3 as in those illustrated in FIG. 4 and FIG. 5, and the same effects as in those illustrated in FIG. 4 and FIG. 5 are produced.

The circuit configurations, that is, forms of connection, that implement supply of electric current illustrated in FIG. 2 through FIG. 9 are as follows. FIG. 10 through FIG. 13 are schematic diagrams illustrating forms of connection in the electromagnetic relay 1 illustrated in this first embodiment.

In FIG. 10 through FIG. 13 as well, reference numeral 2 denotes fixed contacts, reference numeral 3 denotes movable contacts, reference character SL denotes a contact set on the fixed contact 2 side, that is, on the left side as viewed from direction S (approaching direction), and reference character SR denotes a contact set on the right side as viewed from direction S (approaching direction). Further, reference numeral 11*a* denotes terminal portions connected to the fixed contacts 2, reference numeral 12*a* denotes terminal portions connected to the movable contacts 3, a broken line indicates the external form of the electromagnetic relay 1, a solid line indicates a form of connection between the terminal portions of the electromagnetic relay 1 and a load 50 and a power supply 60, and reference character I indicates a direction in which electric current flows through the fixed contacts 2 and the movable contacts 3.

Figure 10:
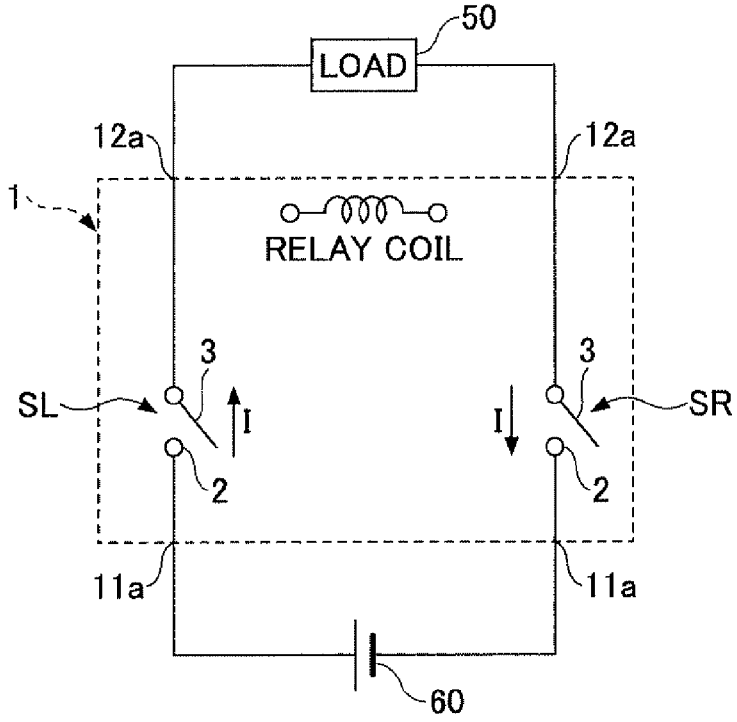
FIG. 10 is a schematic diagram illustrating a form of interconnection in the electromagnetic relay according to the first embodiment of the present invention.
Figure 11:
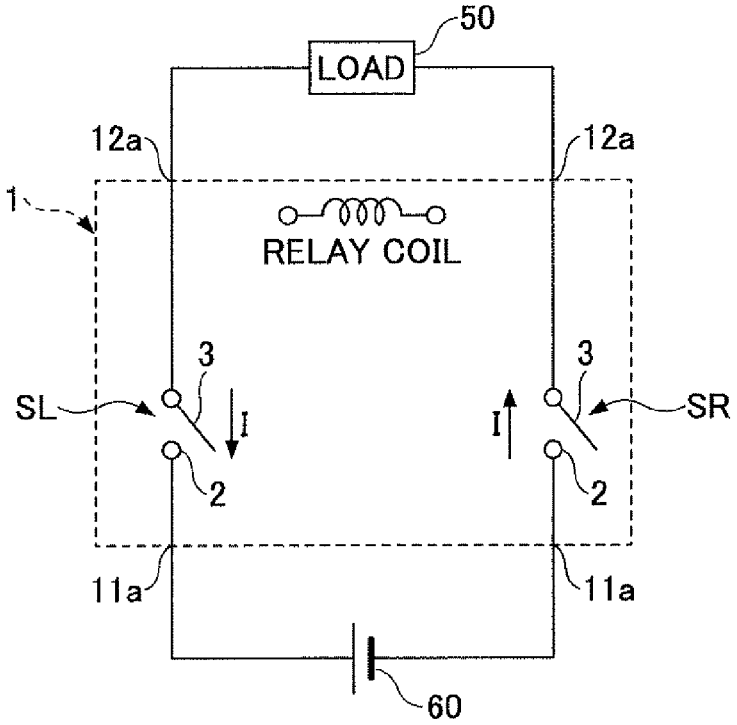
FIG. 11 is a schematic diagram illustrating another form of interconnection in the electromagnetic relay according to the first embodiment of the present invention.
Figure 12:
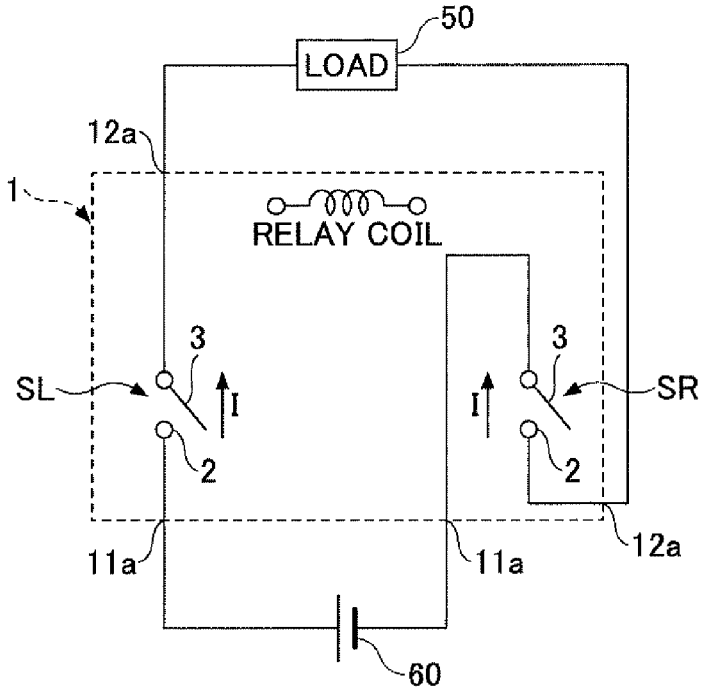
FIG. 12 is a schematic diagram illustrating yet another form of interconnection in the electromagnetic relay according to the first embodiment of the present invention.
Figure 13:
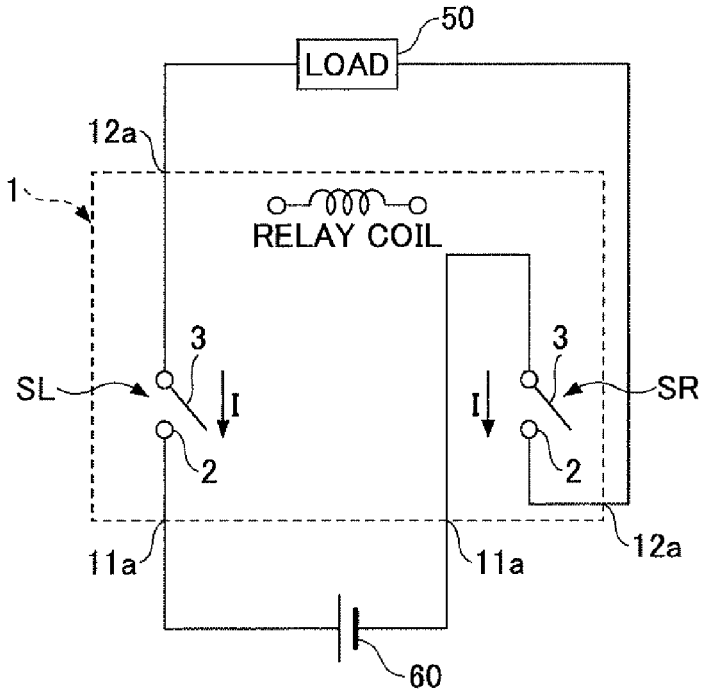
FIG. 13 is a schematic diagram illustrating yet another form of interconnection in the electromagnetic relay according to the first embodiment of the present invention.

FIG. 10 illustrates a form of connection corresponding to FIG. 2 and FIG. 4 and FIG. 11, illustrates a form of connection corresponding to FIG. 3 and FIG. 5, where the adjacent left and right contact sets SL and SR are opposite in the electric current direction I. FIG. 12 illustrates a form of connection corresponding to FIG. 6 and FIG. 8 and FIG. 13 illustrates a form of connection corresponding to FIG. 7 and FIG. 9, where the electric current direction I is the same in the adjacent left and right contact sets SL and SR.

Thus, according to the electromagnetic relay 1 of this first embodiment, irrespective of the electric current direction I in the adjacent left and right contact sets SL and SR, it is possible to exert both of an electromagnetic force and an attractive force on an arc to blow off the arc in a desired direction by suitably disposing the permanent magnets 4 and the ferromagnetic bodies 5.

[b] Second Embodiment

In the above-described electromagnetic relay 1 of the first embodiment, the ferromagnetic bodies 5 provided on the peripheral (outer) side of the gaps have a rectangular parallelepiped shape. Alternatively, the ferromagnetic bodies 5 may also have a shape with a V-shaped portion on the side directed to the gap. A description is given of this configuration in a second embodiment described below.

Figure 14:
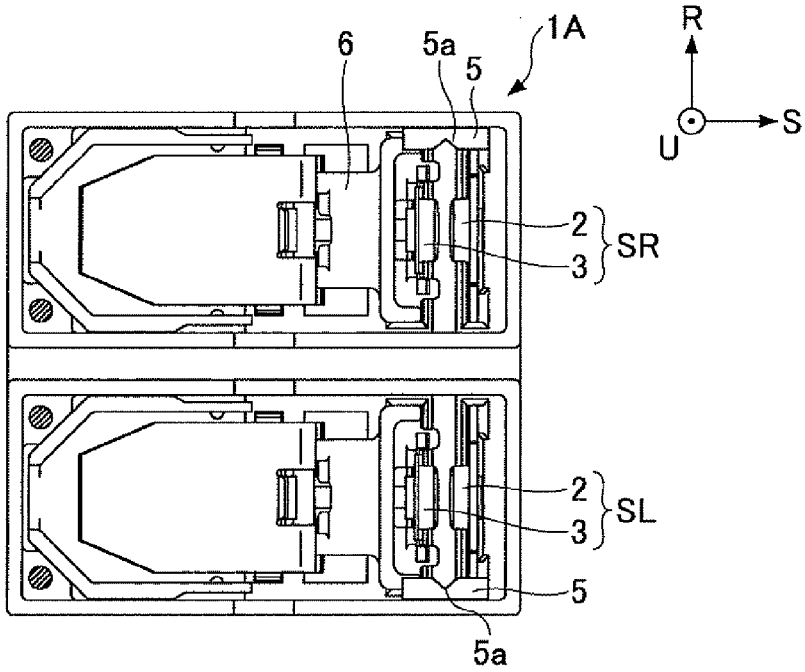
FIG. 14 is a schematic diagram illustrating an electromagnetic relay according to a second embodiment of the present invention.
Figure 15:
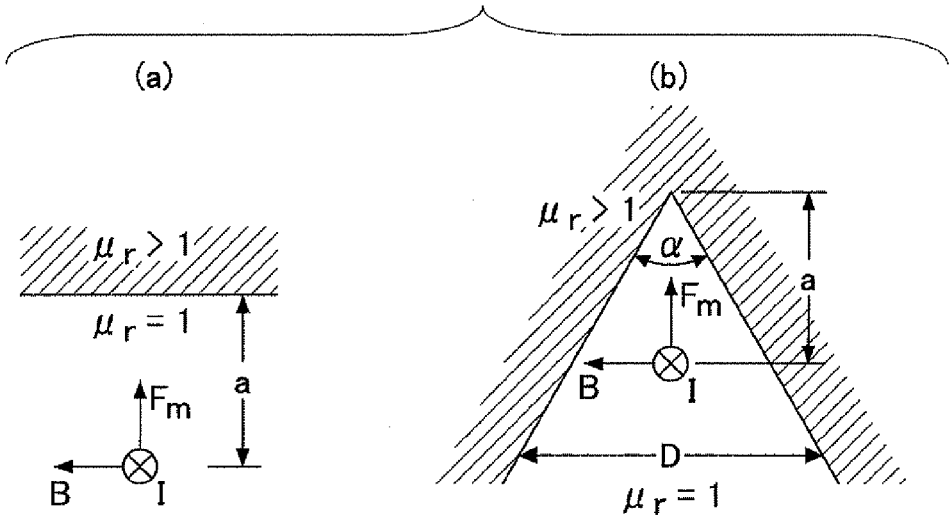
FIG. 15 is a schematic diagram illustrating a principle in the electromagnetic relay according to the second embodiment of the present invention.

FIG. 14 is a schematic diagram illustrating an electromagnetic relay 1A according to the second embodiment. FIG. 15 is a schematic diagram illustrating a configuration of the ferromagnetic body 5 of the electromagnetic relay 1A of this second embodiment (illustrated in (b)) based on a comparison with that of a rectangular parallelepiped shape (illustrated in (a)). The electromagnetic relay 1A has the same configuration as the electromagnetic relay 1 of the first embodiment except the shape of the ferromagnetic bodies 5. Accordingly, the same elements as those of the first embodiment are referred to by the same reference numerals or characters, and a description thereof is omitted.

As illustrated in FIG. 14, each of the ferromagnetic bodies 5 of the electromagnetic relay 1A of this second embodiment includes a V-shaped portion 5*a*, depressed toward the peripheral or direction R side and extending (elongated) in direction U, on the side opposed to (facing) the gap of the contact set SL or SR.

A force F of the rectangular parallelepiped ferromagnetic body 5 illustrated in the first embodiment to attract an arc, that is, electric current, is generated based on magnetic field B defined by below-described Eq. (1):

$$B = \frac{\mu_0}{4\pi} \cdot \frac{\mu_r - 1}{\mu_r + 1} \cdot \frac{I}{a}, \tag{1}$$

where $\mu_r$ (>1) is the relative permeability of the ferromagnetic body 5, $\mu_0$ (>1) is permeability in air, I is electric current flowing as an arc, and a is a distance between an arc and the rectangular parallelepiped ferromagnetic body 5 illustrated in (a) of FIG. 15. That is, the force F also is an electromagnetic force based on Fleming's left-hand rule but is referred to as "attractive force" in embodiments of the present invention for distinction from an electromagnetic force based on the magnetic flux generated by the permanent magnet 4.

In the ferromagnetic body 5 having the V-shaped portion 5*a* whose pair of right and left wall faces forms an angle α as illustrated in (b) of FIG. 15, magnetic field B is multiplied by a factor (n−1), where n is determined by below-described Eq. (2):

$$n = \frac{360°}{\alpha}. \tag{2}$$

For example, if α is 45°, n=360°/45°=8, so that the factor is 8−1=7.

That is, as the angle α formed by the wall faces defining the V-shaped portion 5*a* decreases, the factor (n−1) increases, so that magnetic field B also increases, thereby making it possible to increase the attractive force. According to the electromagnetic relay 1A of this second embodiment, by increasing the force of the ferromagnetic body 5 to attract an arc based on this magnetic field B increasing effect of the V-shaped portion 5*a*, it is possible to further increase the arc absorbing and suppressing (extinguishing) effect of the ferromagnetic body 5. Further, it is also possible to improve the durability, interruption performance, and opening and closing performance of the electromagnetic relay 1A.

The V-shaped portion 5*a* of the ferromagnetic body 5 may be so formed as to reduce a distance D between its wall faces in direction S (approaching direction) linearly as illustrated in FIG. 14 and FIG. 15(*b*) or in a stepwise manner toward the peripheral side.

[c] Third Embodiment

In the above-described electromagnetic relay 1 of the first embodiment, the permanent magnets 4 are fixed to the case 10 by press fitting. Alternatively, the ferromagnetic bodies 5 as well as the permanent magnets 4 may be fixed to the case 10 as a unit by insert molding. A description is given of this configuration in a third embodiment described below.

Figure 16:
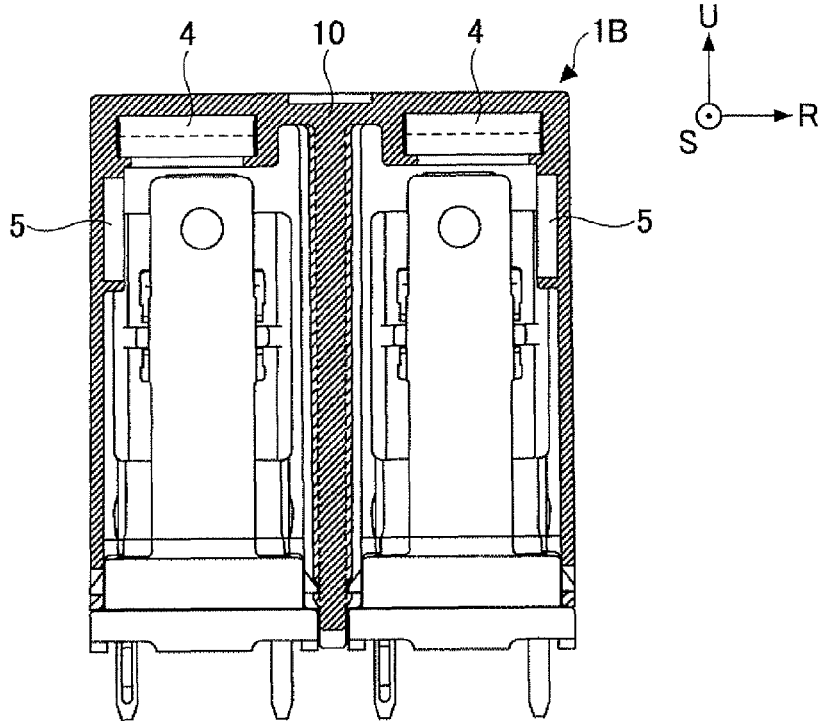
FIG. 16 is a schematic diagram illustrating a form of fixation of permanent magnets and ferromagnetic bodies in an electromagnetic relay according to a third embodiment of the present invention.

FIG. 16 is a schematic diagram illustrating an electromagnetic relay 1B of this third embodiment. The electromagnetic relay 1B has the same configuration as the electromagnetic relay 1 illustrated in the first embodiment except the form of fixation of the permanent magnets 4 and the ferromagnetic bodies 5 to the case 10. Accordingly, the same elements as those of the first embodiment are referred to by the same reference numerals or characters, and a description thereof is omitted.

According to the electromagnetic relay 1B of this third embodiment, the permanent magnets 4 and the ferromagnetic bodies 5 are embedded in advance in the case 10 as a case component forming an outer shell by insert molding so as to be fixed to the case 10 as a unit.

According to the electromagnetic relay 1B of this third embodiment, the permanent magnets 4 and the ferromagnetic bodies 5 may be fixed to the case 10 in a single process by insert molding, which makes it possible to assemble and manufacture the electromagnetic relay 1B with more ease.

[d] Fourth Embodiment

Alternatively, in place of the form of fixation illustrated in the third embodiment, both the permanent magnets 4 and the ferromagnetic bodies 5 may be fixed to the case 10 by press fitting. A description is given of this configuration in a fourth embodiment described below.

Figure 17:
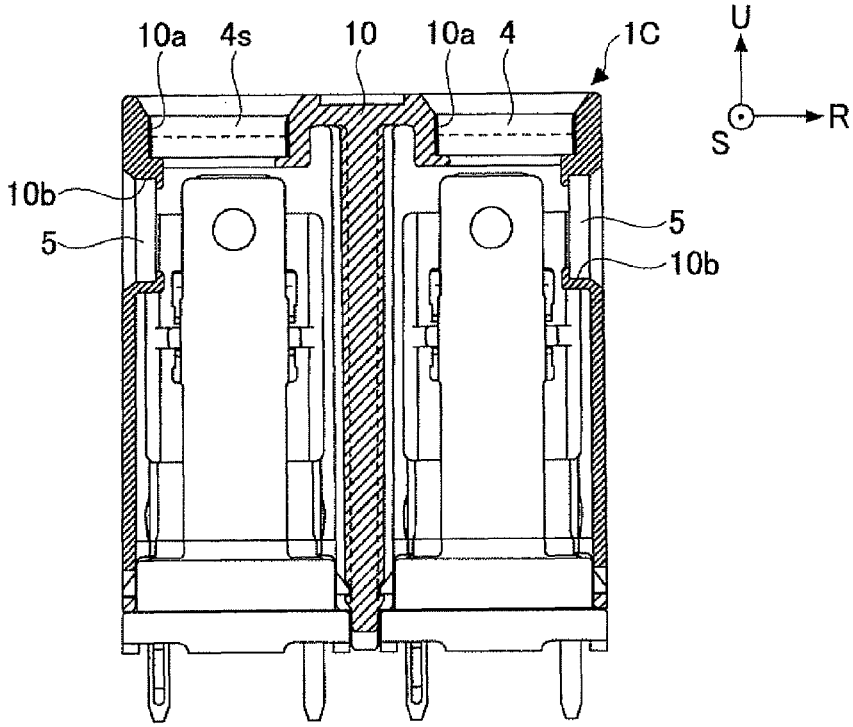
FIG. 17 is a schematic diagram illustrating a form of fixation of permanent magnets and ferromagnetic bodies in an electromagnetic relay according to a fourth embodiment of the present invention.

FIG. 17 is a schematic diagram illustrating an electromagnetic relay 1C of this fourth embodiment. The electromagnetic relay 1C has the same configuration as the electromagnetic relay 1 illustrated in the first embodiment except the form of fixation. Accordingly, the same elements as those of the first embodiment are referred to by the same reference numerals or characters, and a description thereof is omitted.

As illustrated in FIG. 17, according to the electromagnetic relay 1 of this fourth embodiment, the case 10 as a case component forming an outer shell is provided with the two recesses 10*a* and two recesses 10*b* that allow press fitting of the permanent magnets 4 and the ferromagnetic bodies 5, respectively. The permanent magnets 4 are press-fit into the corresponding recesses 10*a* from outside, and the ferromagnetic bodies 5 are press-fit into the corresponding recesses 10*b* from outside, so that the permanent magnets 4 and the ferromagnetic bodies 5 are fixed to the case 10 as a unit.

Here, according to the electromagnetic relay 1C of this fourth embodiment, compared with the form of fixation using insert molding described above in the third embodiment, which may use large-scale manufacturing facilities for molding, it is possible to suppress an increase in manufacturing cost by fixing the permanent magnets 4 and the ferromagnetic bodies 5 to the case 10 by press fitting from outside.

This fourth embodiment may be effective in manufacturing at a trial manufacture stage. In a situation where the production of electromagnetic relays according to an embodiment of the present invention is at a mass production stage so that it is possible to ensure the amount of production commensurate with an increase in the cost of manufacturing facilities, the form illustrated in the third embodiment may be more suitable.

[e] Fifth Embodiment

Alternatively, in place of the form of fixation illustrated in the fourth embodiment, both the permanent magnets 4 and the ferromagnetic bodies 5 may be first fixed temporarily to the case 10 by press fitting and then fixed permanently to the case 10 with an adhesive agent as a unit. A description is given of this configuration in a fifth embodiment described below.

Figure 18:
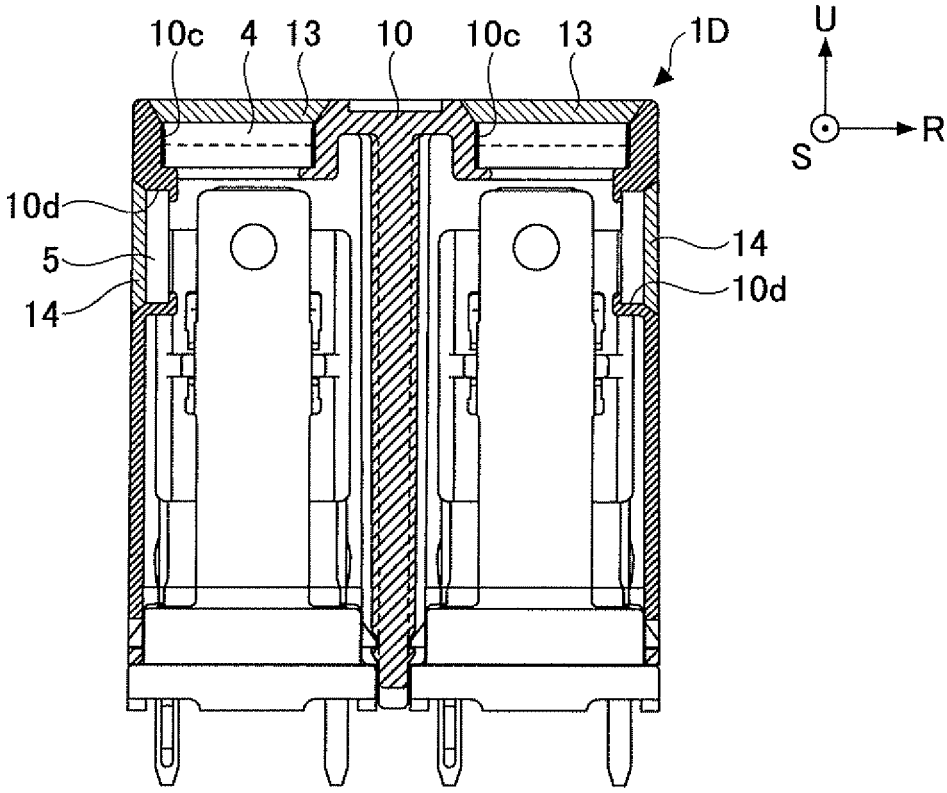
FIG. 18 is a schematic diagram illustrating a form of fixation of permanent magnets and ferromagnetic bodies in an electromagnetic relay according to a fifth embodiment of the present invention.

FIG. 18 is a schematic diagram illustrating an electromagnetic relay 1D of this fifth embodiment. The electromagnetic relay 1D has the same configuration as the electromagnetic relay 1 illustrated in the first embodiment except the form of fixation. Accordingly, the same elements as those of the first embodiment are referred to by the same reference numerals or characters, and a description thereof is omitted.

According to the electromagnetic relay 1 of this fifth embodiment, the case 10 as a case component forming an outer shell is provided with recesses 10*c* and 10*d* that allow press fitting of the permanent magnets 4 and the ferromagnetic bodies 5 and are larger in clearance than the recesses 10*a* and 10*b* of the third embodiment, respectively. The permanent magnets 4 and the ferromagnetic bodies 5 are first press-fit for temporal fixation into the recesses 10*c* and 10*d*, respectively. Thereafter, an adhesive agent 13 is applied to fill in concave spaces of a truncated cone shape on the outer side of the permanent magnets 4 and an adhesive agent 14 is applied to fill in concave spaces of a truncated cone shape on the outer side of the ferromagnetic bodies 5, so that the permanent magnets 4 and the ferromagnetic bodies 5 are fixed to the case 10 as a unit with the adhesive agents 13 and 14, respectively.

According to the electromagnetic relay 1D of this fifth embodiment, it is possible to suitably remove the ferromagnetic bodies 5 from the recesses 10*d* with clearance by removing the applied adhesive agent 14 and replace them if there is need to replace the ferromagnetic bodies 5 because of their continuous absorption of arcs.

Likewise, it is also possible to suitably remove the permanent magnets 4 from the recesses 10*c* with clearance by removing the applied adhesive agent 13 and replace them if there is need to replace the permanent magnets 4 because of age degradation or deficiencies such as misalignment. Therefore, it is possible to improve the durability of the electromagnetic relay 1D as a whole and to prolong its useful service life.

According to one aspect of the present invention, an electromagnetic relay may be improved in the arc suppressing (extinguishing) effect with better opening and closing performance with a relatively minor and inexpensive change. Thus, application of embodiments of the present invention to domestic or industrial electromagnetic relays is beneficial.

According to an aspect of the present invention, an electromagnetic relay includes a plurality of contact sets each including a fixed contact and a movable contact displaceable in a first direction to approach the fixed contact and in a second direction to move away from the fixed contact; a plurality of permanent magnets each provided on a peripheral side of a corresponding one of the contact sets and having a polarity direction perpendicular to the first and second directions; and a plurality of ferromagnetic bodies parallel to the polarity directions of the permanent magnets and the first and second directions, wherein in a DC electric current flowing through each of the contact sets, a direction of a force exerted based on the permanent magnet is equal to a direction of a force exerted based on the ferromagnetic body.

According to the above-described electromagnetic relay, it is possible to deflect and blow off an arc generated between the fixed contact and the movable contact in a direction away from the contact set with an electromagnetic force based on Fleming's left-hand rule, generated by the arc and a magnetic flux generated by the permanent magnet. Further, by causing the ferromagnetic body to exert an attractive force for attraction in the same direction as the direction in which the electromagnetic force is generated, it is possible to ensure that the arc is first absorbed by the ferromagnetic body and then extinguished based on the effect of both the electromagnetic force and the attractive force. Here, the electromagnetic force is a force exerted based on the permanent magnet, and the attractive force is a force exerted based on the ferromagnetic body.

This makes it possible to cause the arc to go through the ferromagnetic body before the arc reaches one of the fixed contact and the movable contact from the other, and to cause the energy of the arc to be electrically and thermally absorbed by the ferromagnetic body. This makes it possible to reduce the heating and subsequent evaporation of the surfaces of the fixed contact and the movable contact by the arc and to prevent the abrasion of the surfaces as much as possible.

Further, by weakening (reducing) the arc with the ferromagnetic body, it is possible to prevent reduction in the interruption performance and, further, in the opening and closing performance, due to continuation of electrical conduction between the movable contact and the fixed contact due to the arc particularly in the case of opening the contact set of the electromagnetic relay.

In addition, according to the above-described electromagnetic relay, it is possible to dispense with techniques such as increasing the fixed contact and the movable contact in individual volume or number and increasing the gap between the fixed contact and the movable contact, which have been conventionally practiced as measures against arc-caused overheating. This makes it possible to avoid an increase in manufacturing cost. Further, since the member caused to absorb energy is the ferromagnetic body, which is a separate component, it is possible to prevent the properties of components contributing to the opening and closing action of the electromagnetic relay from being affected, so that it is possible to suppress abrasion of the contact set in the case of conducting and interrupting a large electric current as well.

Further, the multiple contact sets each formed of the fixed contact and the movable contact may be opposite in the direction in which the electromagnetic force and the attractive force are exerted based on a suitable combination of the polarity directions of the permanent magnets and the direction in which DC electric current flows. This makes it possible to cancel a force exerted on the electromagnetic relay by the reaction of the electromagnetic force and the attractive force. This makes it possible to prevent a reaction force resulting from blowing off the arc from being exerted continuously on the electromagnetic relay, so that it is possible to improve the durability of the electromagnetic relay. Here, the polarity direction refers to a direction in which a magnetic flux is generated from the north pole of the permanent magnet.

Further, in the electromagnetic relay, the exertion directions (in each of which the electromagnetic force and the attractive force are exerted) of the multiple contact sets may be opposite and outward, so that the ferromagnetic bodies may be provided one on each peripheral side of the electromagnetic relay. This makes it easier to provide the ferromagnetic bodies in the electromagnetic relay, thus making it possible to assemble and manufacture the electromagnetic relay with more ease.

In addition, the electromagnetic relay includes the multiple contact sets. Therefore, it is possible to open and close both the positive terminal side and the negative terminal side of a load connected to a DC power supply. Therefore, it is possible to prevent electric current from flowing through the load for some reason such as inclusion of an inductive element in a circuit after interrupting the electric current by opening contacts. As a result, it is possible to improve the opening and closing performance.

Here, in the above-described electromagnetic relay, it is preferable that the contact sets be adjacently disposed so that the respective first and second directions are parallel to each other. The first and second directions refer to a direction in which the movable contact approaches and comes into contact with the fixed contact and a direction in which the movable contact is separated and moves away from the fixed contact.

According to the above-described electromagnetic relay, the present invention may be applied to a so-called double contact type.

In the above-described electromagnetic relay, the form of arrangement (disposition) of and the positional correlation between the permanent magnets and the ferromagnetic bodies relative to the multiple contact sets may adopt various combinations.

For example, in the above-described electromagnetic relay, the ferromagnetic bodies may be disposed perpendicular to a third direction in which the contact sets are adjacently disposed as viewed from the first direction, the permanent magnets may be disposed perpendicular to a fourth direction perpendicular to the first and second directions and the third direction, the contact sets may be opposite in a direction of the DC electric current flowing therethrough, and the polarity directions of the permanent magnets may be equal (FIG. 2 and FIG. 3).

Alternatively, in the above-described electromagnetic relay, the permanent magnets may be disposed perpendicular to a third direction in which the contact sets are adjacently disposed as viewed from the first direction, the ferromagnetic bodies may be disposed perpendicular to a fourth direction perpendicular to the first and second directions and the third direction, the contact sets may be opposite in a direction of the DC electric current flowing therethrough, and the polarity directions of the permanent magnets may be opposite (FIG. 4 and FIG. 5).

Alternatively, in the above-described electromagnetic relay, the ferromagnetic bodies may be disposed perpendicular to a third direction in which the contact sets are adjacently disposed as viewed from the first direction, the permanent magnets may be disposed perpendicular to a fourth direction perpendicular to the first and second directions and the third direction, the contact sets may be equal in a direction of the DC electric current flowing therethrough, and the polarity directions of the permanent magnets may be opposite (FIG. 6 and FIG. 7).

Alternatively, in the above-described electromagnetic relay, the permanent magnets may be disposed perpendicular to a third direction in which the contact sets are adjacently disposed as viewed from the first direction, the ferromagnetic bodies may be disposed perpendicular to a fourth direction perpendicular to the first and second directions and the third direction, the contact sets may be equal in a direction of the DC electric current flowing therethrough, and the polarity directions of the permanent magnets may be equal (FIG. 8 and FIG. 9).

In the above-described electromagnetic relay, the ferromagnetic bodies may have respective surfaces on a side of the contact sets exposed to an interior space of a case component configured to form an outer shell.

According to the above-described electromagnetic relay, it is possible to ensure a sufficient attractive force, so that it is possible to ensure absorption of the arc by the ferromagnetic body. When it is possible to ensure a sufficient attractive force, the surface of the ferromagnetic body on the contact set side may be suitably covered with molding resin or an adhesive agent.

In addition, in the above-described electromagnetic relay, it is preferable that the permanent magnets have respective surfaces on the side of the contact sets exposed to the interior space of the case component.

According to the above-described electromagnetic relay, it is possible to ensure a sufficient electromagnetic force, so that it is possible to ensure deflection of the arc by the permanent magnet. When it is possible to ensure a sufficient electromagnetic force, the surface of the permanent magnet on the contact set side may be suitably covered with molding resin or an adhesive agent.

In the above-described electromagnetic relay, the ferromagnetic bodies may include one selected from the group consisting of iron, cobalt, nickel, an iron-containing alloy, a cobalt-containing alloy, and a nickel-containing alloy.

Here, in the above-described electromagnetic body, it is preferable that the ferromagnetic bodies have one of a rectangular parallelepiped shape and a flat plate shape.

According to the above-described electromagnetic relay, it is possible to manufacture the ferromagnetic body with more ease, thus making it possible to manufacture the electromagnetic relay with more ease.

Further, in the above-described electromagnetic relay, it is preferable that surfaces of the ferromagnetic bodies on a side of the contact sets include respective V-shaped portions.

According to the above-described electromagnetic relay, it is possible to increase the attractive force of the ferromagnetic body to attract the arc, and to suitably adjust the specifications of the attractive force. As described above, it is possible to increase the attractive force by reducing the angle formed by the wall faces of the V-shaped portion.

In addition, the electromagnetic relay may include a case component configured to form an outer shell, where the permanent magnets and the ferromagnetic bodies may be insert-molded into and fixed to the case component as a unit.

According to the above-described electromagnetic relay, the permanent magnets and the ferromagnetic bodies may be fixed to the case component in a short period of time by insert molding, thus making it possible to assemble and manufacture the electromagnetic relay with more ease.

Alternatively, the above-described electromagnetic relay may include a case component configured to form an outer shell, the case component including a plurality of recesses, where the permanent magnets and the ferromagnetic bodies may be press-fit into the recesses to be fixed to the case component as a unit.

According to the above-described electromagnetic relay, it is possible to suppress an increase in cost due to large-scale manufacturing facilities for performing insert molding by fixing the permanent magnets and the ferromagnetic bodies to the case component by press fitting.

Alternatively, the above-described electromagnetic relay may include a case component configured to form an outer shell, the case component including a plurality of recesses, where the permanent magnets and the ferromagnetic bodies may be press-fit into the recesses to be fixed to the case component with an adhesive agent as a unit.

According to the above-described electromagnetic relay, it is possible to suitably replace the ferromagnetic body when there is need for the replacement because of its progress in wear due to its continuous absorption of arc. This makes it possible to improve the durability of the electromagnetic relay as a whole and to prolong its useful service life.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that various changes, substitutions, and alterations could be made hereto without departing from the spirit and scope of the invention.

What is claimed is:

1. An electromagnetic relay, comprising:

a plurality of contact sets each including a fixed contact and a movable contact displaceable in a first direction to approach the fixed contact and in a second direction to move away from the fixed contact;

a plurality of permanent magnets each provided on a peripheral side of a corresponding one of the contact sets and having a polarity direction perpendicular to the first and second directions; and a plurality of ferromagnetic bodies that include respective surfaces facing toward each other, wherein the respective surfaces are parallel to the polarity directions of the permanent magnets and the first and second directions, wherein in a DC electric current flowing through each of the contact sets, a direction of a force exerted based on the permanent magnet is equal to a direction of a force exerted based on the ferromagnetic body.

2. The electromagnetic relay as claimed in claim 1, wherein the contact sets are adjacently disposed so that the respective first and second directions are parallel to each other.

3. The electromagnetic relay as claimed in claim 2, wherein the ferromagnetic bodies are disposed perpendicular to a third direction in which the contact sets are adjacently disposed as viewed from the first direction, the permanent magnets are disposed perpendicular to a fourth direction perpendicular to the first and second directions and the third direction, the contact sets are opposite in a direction of the DC electric current flowing therethrough, and the polarity directions of the permanent magnets are equal.

4. The electromagnetic relay as claimed in claim 3, farther comprising:

a case component configured to form an outer shell, wherein the ferromagnetic bodies have respective surfaces on a side of the contact sets exposed to an interior space of the case component.

5. The electromagnetic relay as claimed in claim 4, wherein the permanent magnets have respective surfaces on the side of the contact sets exposed to the interior space of the case component.

6. The electromagnetic relay as claimed in claim 2, wherein the ferromagnetic bodies are disposed perpendicular to a third direction in which the contact sets are adjacently disposed as viewed from the first direction, the permanent magnets are disposed perpendicular to a fourth direction perpendicular to the first and second directions and the third direction, the contact sets are equal in a direction of the DC electric current flowing therethrough, and the polarity directions of the permanent magnets are opposite.

7. The electromagnetic relay as claimed in claim 6, further comprising:

a case component configured to form an outer shell, wherein the ferromagnetic bodies have respective surfaces on a side of the contact sets exposed to an interior space of the case component.

8. The electromagnetic relay as claimed in claim 7, wherein the permanent magnets have respective surfaces on the side of the contact sets exposed to the interior space of the case component.

9. The electromagnetic relay as claimed in claim 1, wherein the ferromagnetic bodies comprise a material selected from a group of materials consisting of iron, cobalt, nickel, an iron-containing alloy, a cobalt-containing alloy, and a nickel-containing alloy.

10. The electromagnetic relay as claimed in claim 1, wherein the ferromagnetic bodies have one of a rectangular parallelepiped shape and a flat plate shape.

11. The electromagnetic relay as claimed in claim 1, wherein surfaces of the ferromagnetic bodies on a side of the contact sets comprise respective V-shaped portions.

12. The electromagnetic relay as claimed in claim 1, further comprising:

a case component configured to form an outer shell, wherein the permanent magnets and the ferromagnetic bodies are insert-molded into and fixed to the case component as a unit.

13. The electromagnetic relay as claimed in claim 1, further comprising:

a case component configured to form an outer shell, the case component including a plurality of recesses, wherein the permanent magnets and the ferromagnetic bodies are press-fit into the recesses to be fixed to the case component as a unit.

14. The electromagnetic relay as claimed in claim 1, further comprising:

a case component configured to form an outer shell, the case component including a plurality of recesses, wherein the permanent magnets and the ferromagnetic bodies are press-fit into the recesses to be fixed to the case component with an adhesive agent as a unit.

15. An electromagnetic relay, comprising:

a first contact set and a second contact set each including a fixed contact and a movable contact displaceable in a first direction to approach the fixed contact and in a second direction to move away from the fixed contact, wherein the first and second contact sets are arranged in a third direction perpendicular to the first and second directions;

a first permanent magnet and a second permanent magnet corresponding to the first and second contact sets, respectively, wherein the first and second permanent magnets are arranged in the third direction and are positioned in a fourth direction from the first and second contact sets, respectively, the fourth direction being perpendicular to the first, second, and third directions, and each of the first and second permanent magnets has a polarity direction parallel to the fourth direction; and a first ferromagnetic body and a second ferromagnetic body that are arranged in the third direction and include respective surfaces facing toward each other across the first and second contact sets, wherein the respective surfaces are parallel to the polarity direction of each of the first and second permanent magnets and the first and second directions.

16. An electromagnetic relay, comprising:

a first contact set and a second contact set each including a fixed contact and a movable contact displaceable in a first direction to approach the fixed contact and in a second direction to move away from the fixed contact;

a first permanent magnet provided on a peripheral side of the first contact set, and a second permanent magnet provided on a peripheral side of the second contact set, wherein each of the first and second permanent magnets has a polarity direction perpendicular to the first and second directions; and a first ferromagnetic body that includes a first surface, and a second ferromagnetic body that includes a second surface, wherein the first surface and the second surface face toward each other and are parallel to the polarity directions of the permanent magnets and the first and second directions, wherein the first and second permanent magnets are arranged so that a direction in which the magnetic flux is generated and a direction in which a DC electric current flows though each of the first and second contact sets are such directions as to blow off first and second arcs toward the first and second ferromagnetic bodies, respectively, the first and second arcs being to be generated in first and second gaps between the fixed contacts and the corresponding movable contacts of the first and second contact sets, respectively.

* * * * *